US009005499B2

(12) United States Patent
Lee et al.

(10) Patent No.: US 9,005,499 B2
(45) Date of Patent: Apr. 14, 2015

(54) METHOD FOR MANUFACTURING RETAINER RING OF CHEMICAL MECHANICAL POLISHING DEVICE

(75) Inventors: Han-Ju Lee, Gyeonggi-do (KR); Min-Gyu Kim, Gyeonggi-do (KR); Kwang-Hee Ku, Chungcheongbuk-do (KR); Jae-Bok Lee, Gyeonggi-do (KR)

(73) Assignee: Will Be S & T Co., Ltd., Gyeonggi-Do (KR)

( * ) Notice: Subject to any disclaimer, the term of this patent is extended or adjusted under 35 U.S.C. 154(b) by 399 days.

(21) Appl. No.: 13/579,728

(22) PCT Filed: Feb. 22, 2011

(86) PCT No.: PCT/KR2011/001152

§ 371 (c)(1),
(2), (4) Date: Aug. 17, 2012

(87) PCT Pub. No.: WO2011/105730

PCT Pub. Date: Sep. 1, 2011

(65) Prior Publication Data

US 2012/0319321 A1 Dec. 20, 2012

(30) Foreign Application Priority Data

Feb. 25, 2010 (KR) ..... 10-2010-0017161

(51) Int. Cl.
*H01L 21/306* (2006.01)
*B24B 37/32* (2012.01)

(52) U.S. Cl.
CPC ..... *B24B 37/32* (2013.01)

(58) Field of Classification Search
USPC ..... 264/271.1, 275
See application file for complete search history.

(56) References Cited

U.S. PATENT DOCUMENTS 5,714,106 A * 2/1998 Yoda et al. ..... 264/275
2007/0034335 A1* 2/2007 Lee ..... 156/345.12

FOREIGN PATENT DOCUMENTS

KR 20-0242842 Y1 10/2001
KR 10-2006-0131620 A 12/2006
KR 10-2007-0118277 A 12/2007
KR 10-2008-0028392 A 3/2008

* cited by examiner

*Primary Examiner* — Galen Hauth

(74) *Attorney, Agent, or Firm* — Enshan Hong; VLP Law Group LLP

(57) ABSTRACT

Disclosed herein is a method of manufacturing a retainer ring for a chemical mechanical polishing device. Insert pins are coupled to an insert ring member. The insert ring member is thereafter disposed in a mold such that a space is defined around the insert ring member in the mold. Subsequently, molten shell material is injected into the mold to form a shell member. Thereby, the retainer ring is manufactured, having a structure such that the insert ring member is completely covered with the shell member.

9 Claims, 8 Drawing Sheets

METHOD FOR MANUFACTURING RETAINER RING OF CHEMICAL MECHANICAL POLISHING DEVICE

TECHNICAL FIELD

The present invention relates generally to a method for manufacturing a retainer ring of a chemical mechanical polishing device and, more particularly, to a method for manufacturing a retainer ring which is covered with engineering plastic, such as polyetheretherketone (PEEK).

BACKGROUND ART

Generally, semiconductor wafers are processed by surface-planing using chemical mechanical polishing (CMP) device.

The chemical mechanical polishing device polish oxide films or metal thin films applied on the semiconductor wafers using chemical and physical reaction, thus making the surfaces of the semiconductor wafers planar or removing the films therefrom.

As shown in FIG. 1, a representative example of the chemical mechanical polishing device includes a polishing head 5, a polishing pad 6 and a polishing agent supply unit. The polishing head 5 is connected to a motor and rotated by the operation of the motor. A wafer reception portion which contains a semiconductor wafer 7 therein is formed in a lower surface of the polishing head 5. The polishing pad 6 is located beneath the polishing head 5 and polishes the surface of the semiconductor wafer 7 contained in the polishing head 5. The polishing agent supply unit supplies a chemical polishing agent to the polishing pad 6.

Furthermore, a retainer ring 1 which forms the wafer reception portion is mounted to the lower surface of the polishing head 5.

The retainer ring 1 includes a mounting ring member 1 a which is mounted to a carrier of the polishing head 5, and a contact ring member 1*b* which is coupled to a lower portion of the mounting ring member 1*a* and is brought into contact with the polishing pad 6. Polishing agent supply groove are formed in a lower surface of the contact ring member 1*b* at positions spaced apart from each other.

The contact ring member 1*b* is coupled to the mounting ring member 1*a* by bonding using an adhesive.

The mounting ring member 1*a* is made of a metal, such as stainless steel (SUS). The contact ring member 1*b* is made of engineering plastic.

During the chemical mechanical polishing operation, the semiconductor wafer 7 is located in the wafer reception portion of the polishing head 5 and enclosed by a circumferential inner surface of the retainer ring 1 so that the semiconductor wafer 7 is prevented from being undesirably removed from the polishing head 5.

The chemical polishing agent which is in the form of slurry is supplied to the polishing pad 6 by the polishing agent supply unit.

The slurry type chemical polishing agent is supplied into the wafer reception portion through the polishing agent supply groove of the contact ring member 1*b* and oxidizes the surface of the semiconductor wafer 7.

The chemical mechanical polishing device repeatedly conducts the chemical oxidization action of the slurry type chemical polishing agent and the mechanical polishing action of the polishing pad 6, thus making the surface of the semiconductor wafer 7 uniformly planar.

However, the retainer ring 1 cannot reliably support the semiconductor wafer 7 because the bonding force between the mounting ring member 1*a* and the contact ring member 1*b* becomes weaker with the passage of time.

Thus, the surface of the semiconductor wafer 7 may become scratched during the operation of making the surface of the semiconductor wafer 7 planar.

Moreover, the semiconductor wafer 7 may break during the operation of making the surface of the semiconductor wafer 7 planar.

Furthermore, the retainer ring 1 is configured such that the mounting ring member 1*a* made of metal is exposed to the outside.

During the polishing operation, positive or negative charges are generated on the mounting ring member 1*a* made of metal, so that the chemical polishing agent in the form of a slurry more easily becomes stuck to the mounting ring member 1*a*.

If the slurry type chemical polishing agent that has become stuck to the mounting ring member 1*a* hardens, when a subsequent polishing operation is conducted, it may be detached from the mounting ring member 1*a*, thus causing a defective semiconductor wafer 7.

Furthermore, the retainer ring 1 is problematic in that the mounting ring member 1*a* made of metal is corroded by the chemical polishing agent In addition, the chemical mechanical polishing device has a membrane 8 which uses vacuum suction pressure to hold the semiconductor wafer 7 in the polishing head 5.

Chemical polishing agent inserts itself not only between the membrane 8 and the retainer ring 1 but also between the mounting ring member 1*a* and the contact ring member 1*b* and forms particles. The sizes of the particles increase over time.

Some of the particles which come off the elements may scratch the surface of a semiconductor wafer 7 or crack it.

DISCLOSURE

Technical Problem

Accordingly, the present invention has been made keeping in mind the above problems occurring in the prior art, and an object of the present invention is to provide a method for manufacturing a retainer ring of chemical mechanical polishing device by which the retainer ring covered with a shell made of engineering plastic can be easily produced.

Technical Solution

In order to accomplish the above object, the present invention provides a method for manufacturing a retainer ring of a chemical mechanical polishing device, including:

coupling insert pins into respective pin coupling holes formed in an insert ring member, wherein the pin coupling holes are spaced apart from each other;

disposing the insert ring member in a mold by coupling the insert pins to an interior of the mold such that a space is defined around the insert ring member in the mold; and molding a shell member covering the insert ring member by injecting molten shell material into the mold in which the insert ring member is disposed.

Advantageous Effects

As described above, the present invention can easily manufacture a retainer ring which is configured such that a metal ring body is covered with a shell made of synthetic resin.

The present invention reduces the defective proportion that results when manufacturing the retainer ring for chemical mechanical polishing device.

The present invention enhances the productivity and the quality of the retainer ring for chemical mechanical polishing device.

Figure 1:
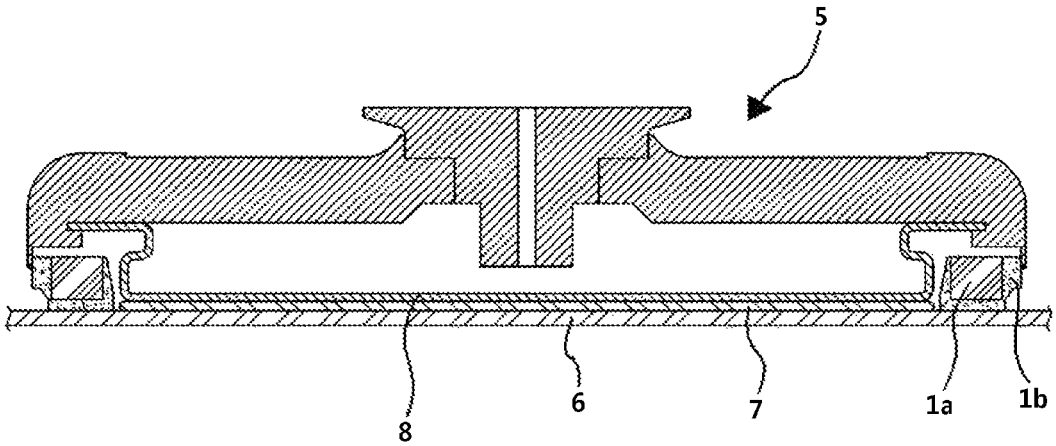
(Prior Art) FIG.1
FIG. 1 is a sectional view schematically showing a polishing head provided with a conventional retainer ring.

*Description of important reference numerals in the drawings*

| | |
|---|---|
| 1: Retainer ring | 2: Insertion ring member |
| 3: Clad member | 10: Retainer ring assembly pin |
| 11: Fitting portion | 12: Spacer projection |
| 13: Seating flange | 14: Pin fixing protrusion |
| 100: Pin assembly | 110: Ring arrangement |
| 120: Molding | 130: Pin cutting |
| 140: Post processing | |

MODE FOR INVENTION

A detailed description will now be made of preferred embodiments with reference to the accompanying drawings.

A method of manufacturing a retainer ring for chemical mechanical polishing device according to the present invention will be explained on the basis of that shown in FIG. 2.

In the method of manufacturing the retainer ring, the retainer ring for chemical mechanical polishing device is manufactured in such a way that the outer surface of an insert ring member 2 is completely covered with a shell member 3.

The method of manufacturing the retainer ring includes using insert pins 10 which are used for manufacturing the retainer ring and are coupled to the insert ring member 2.

The method of manufacturing the retainer ring includes a pin coupling step 100, a ring disposing step 110 and a molding step 120 which are conducted successively.

The method of manufacturing the retainer ring further includes a ring body manufacturing step 90 which is conducted before the ring disposing step 110.

The ring body manufacturing step 90 comprises the step of manufacturing the insert ring member 2.

The method of manufacturing the retainer ring further includes a pin cutting step 130 and a post-processing step 140 which are conducted after the molding step 120.

At the ring body manufacturing step 90, the insert ring member 2 having a plurality of pin coupling holes 2*a* spaced apart from each other is manufactured.

For example, at the ring body manufacturing step 90, the insert ring member 2 is manufactured by die-casting.

It is desirable that the insert ring member 2 be made of metal to increase the weight of the retainer ring 1 and enhance the strength of the retainer ring 1.

For instance, the insert ring member 2 may be made of stainless steel (SUS).

The insert ring member 2 may be made of synthetic resin having predetermined strength.

Preferably, the ring body manufacturing step 90 includes: a resin separating operation of separating synthetic resin from a retainer ring which was scrapped; and a die-casting operation of forming the insert ring member 2 having a plurality of pin coupling holes 2*a* spaced apart from each other using the synthetic resin obtained from the resin separating operation.

As such, in the ring body manufacturing step 90, synthetic resin which was used to form the scrapped retainer ring of the chemical mechanical polishing device is preferably reused.

This reduces the production cost of the retainer ring. Furthermore, in the present invention, manufacturing the retainer ring generates less industrial waste. In addition, the waste treatment costs are reduced.

At the pin coupling step 100, the insert pins 10 are coupled into the respective pin coupling holes 2*a* of the insert ring member 2. The insert pins 10 are disposed in a mold 4 and fastened thereto.

Figure 3:
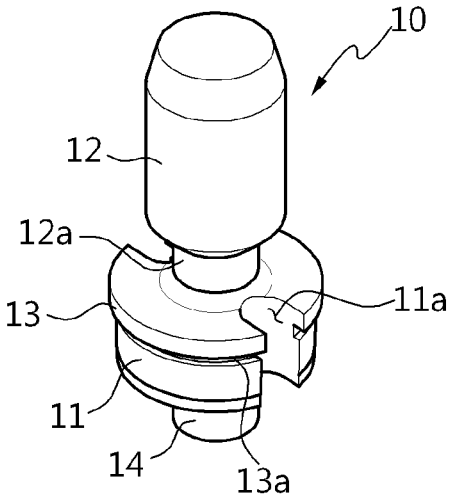
FIG. 3 is a perspective view showing an embodiment of an insert pin used for manufacturing the retainer ring for chemical mechanical polishing device according to the present invention.

Referring to FIG. 3, in an embodiment, each insert pin 10 includes a fitting part 11 which is tightly fitted into the corresponding pin coupling hole 2*a*, and a spacing protrusion 12 which protrudes from the fitting part 11 upwards.

Figure 5:
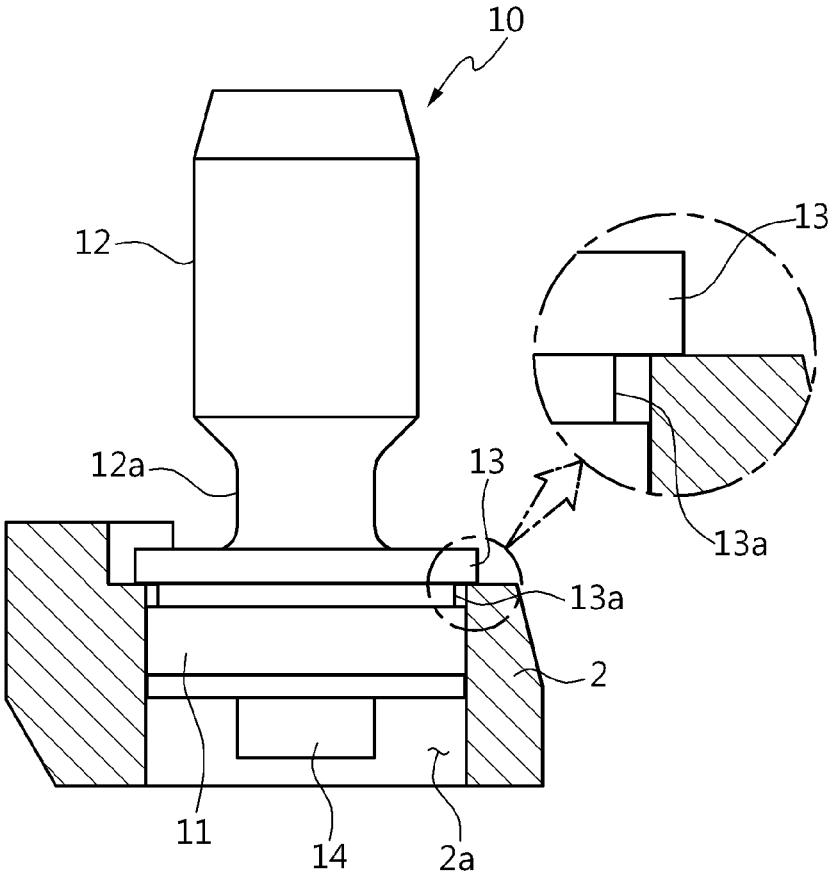
FIG. 5 is a sectional view showing a pin coupling step of the present invention.

Referring to FIG. 5, the spacing protrusion 12 is inserted into a corresponding one of pin mounting holes 4*c* of the mold 4.

As another embodiment, an insert pin (not shown) may be configured such that it is tightly fitted into the corresponding pin coupling hole 2*a* and coupled to a corresponding protrusion (not shown) provided in the mold, although it is not illustrated in the drawings.

Except for the above two embodiments, various methods can be applied to coupling the insert pin 10 to the mold 4.

Hereinafter, the insert pin 10 will be described in more detail with reference to FIG. 5.

The insert pin 10 includes the fitting part 11 which is tightly fitted into the corresponding pin coupling hole 2*a*, and the spacing protrusion 12 which protrudes from the fitting part 11 upwards.

The pin coupling step 100 comprises tightly fitting the fitting part 11 into the corresponding pin coupling hole 2*a* of the insert ring member 2.

A seating flange 13 protrudes outwards from a circumferential outer surface of the fitting part 11. When the fitting part 11 is fitted into the pin coupling hole 2*a*, the seating flange 13 is seated onto an upper surface of the insert ring member 2.

The seating flange 13 is seated onto the upper surface of the insert ring member 2 such that the spacing protrusion 12 is oriented in the vertical direction.

It is desirable that a seating guide groove 13*a* be formed around a circumferential outer surface of an upper end of the fitting part 11.

The circumferential outer surface of the upper end of the fitting part 11 acts as a junction between a lower surface of the seating flange 13 and the fitting part 11.

The seating guide groove 13*a* functions to bring the lower surface of the seating flange 13 into close contact with the upper surface of the insert ring member 2.

As such, at the pin coupling step 100, the seating flange 13 is brought into close contact with the upper surface of the insert ring member 2 in a shape in which the spacing protrusion 12 protrudes in the vertical direction.

Figure 7:
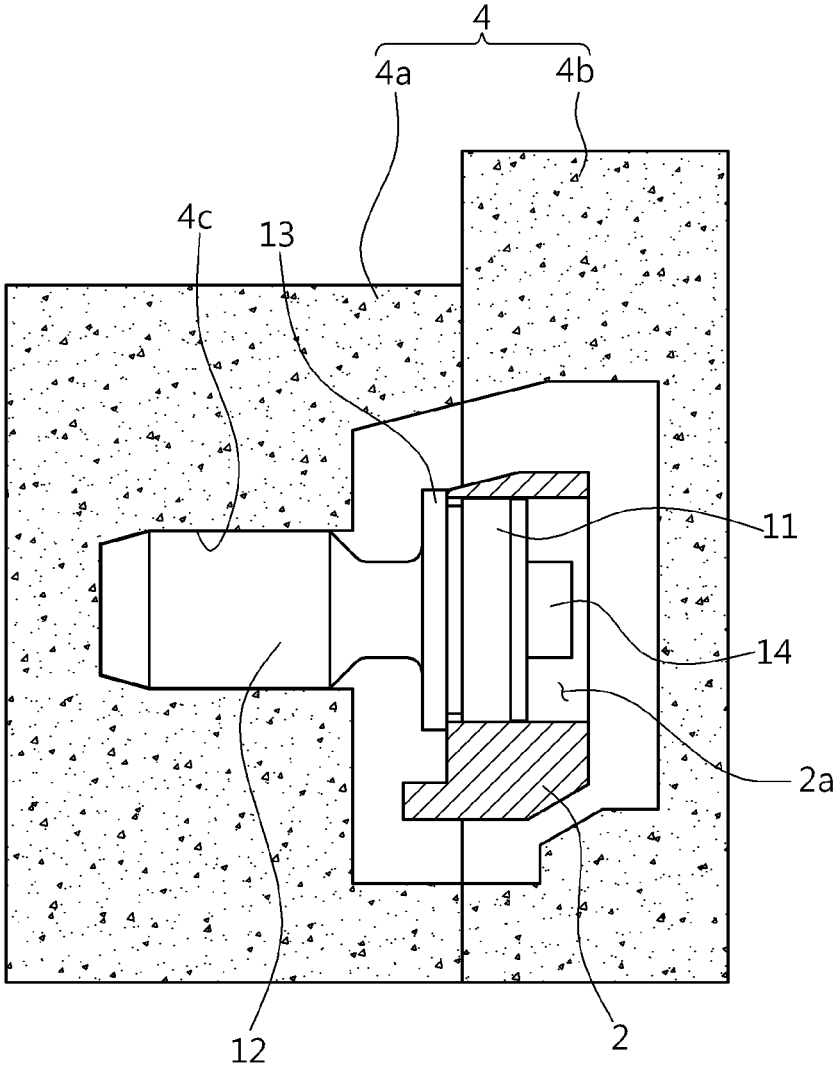
FIG. 7 is a sectional view showing a ring disposing step of the present invention.

Thereby, as shown in FIG. 7, the spacing protrusion 12 of each insert pin 10 can be correctly and easily coupled to the corresponding pin mounting hole 4*c* of the mold 4, at the ring disposing step 11.

Furthermore, clearance is prevented from being formed between the seating flange 13 and the insert ring member 2.

Thus, the retainer ring 1 can be prevented from being made defective by the presence of a clearance.

Figure 6:
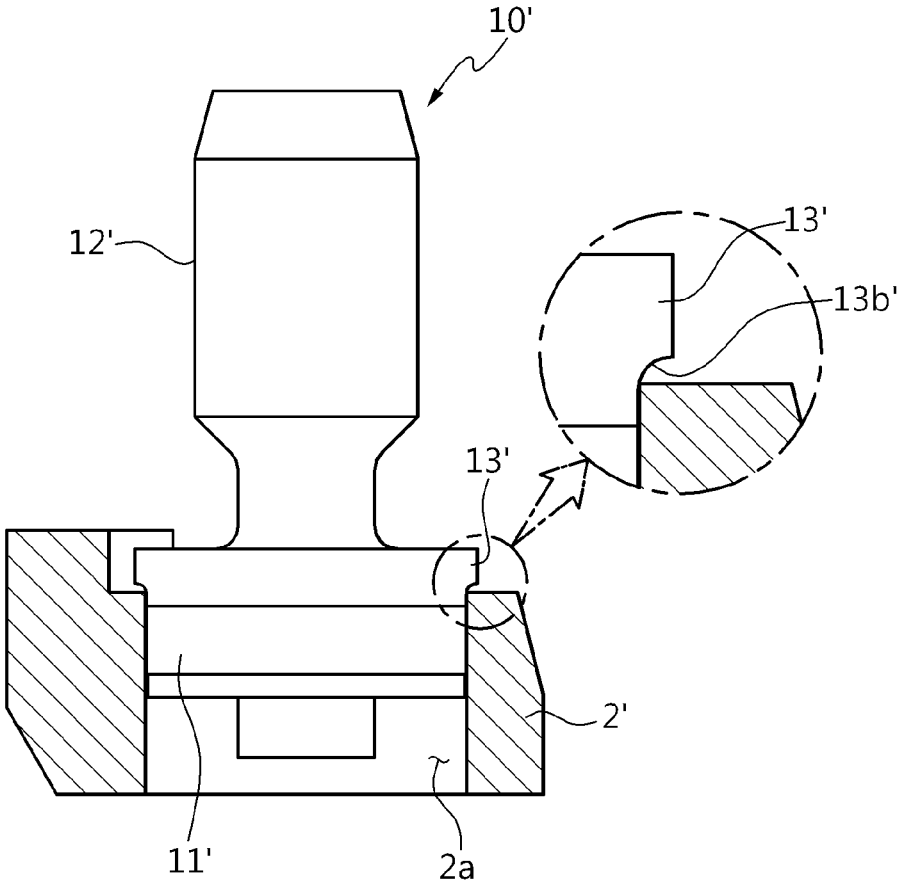
FIG. 6 is a sectional view showing a comparative example of the pin coupling step of the present invention.

A comparative example of the pin coupling step will be explained with reference to FIG. 6. An insert pin 10' for manufacturing a retainer ring of FIG. 6 has a round portion 13*b*' formed around a circumferential outer surface of an upper end of a fitting part 11'.

The circumferential outer surface of the upper end of the fitting part 11' creates a junction between a lower surface of the seating flange 13' and the fitting part 11'.

The round portion 13*b*' is inevitably formed around the circumferential outer surface of the upper end of the fitting part 11' when the seating flange 13' is formed in a shape protruding from the fitting part 11'.

Due to the round portion 13*b*', the seating flange 13' cannot be brought into contact with the upper surface of the insert ring member 2. In other words, a clearance occurs between the seating flange 13' and the upper surface of the insert ring member 2. Thus, the spacing protrusion 12' may move or not be correctly oriented upright in the vertical direction. Furthermore, the spacing protrusion 12 may be displaced from its correct position with respect to the pin mounting hole 4*c* of the mold 4 (refer to FIG. 7).

Therefore, it is difficult to correctly couple the spacing protrusion 12' to the corresponding pin mounting hole 4*c* of the mold 4.

In addition, material for forming the shell member 3 may not be completely charged between the seating flange 13' and the insert ring member 2'. Thus, the coupling force between the material for forming the shell member 3 and the insert pins 10' is reduced, causing a defective retainer ring.

Meanwhile, referring to FIG. 2 again, the ring disposing step 110 follows the pin coupling step 100.

At the ring disposing step 110, the insert pins 10 are coupled to the mold 4 so that the insert ring member 2 is disposed in the mold 4. Then, a space is defined around the inserting member 2 in the mold 4.

The ring disposing step 110 can be embodied in various manners depending on the structure of the insert pin 10.

Referring to FIG. 7, a first embodiment of the ring disposing step 110 uses the insert pin 10 provided with the spacing protrusion 12 which protrudes above one surface of the insert ring member 2.

The pin mounting holes 4*c* into which the corresponding spacing protrusions 12 are inserted are formed in the mold 4. In the first embodiment of the ring disposing step 110, the spacing protrusions 12 of the insert pins 10 are inserted into the corresponding pin mounting holes 4*c* of the mold 4 so that the insert ring member is disposed in the mold 4.

Although it is not illustrated in the drawings, a second embodiment (not shown) of the ring disposing step uses insert pins which are provided with insert portions (not shown) to which corresponding protrusions (not shown) of a mold are coupled.

In other words, at the second embodiment (not shown) of the ring disposing step, the insert ring member is disposed in the mold by inserting the protrusions (not shown) of the mold into the insert portions (not shown) of the corresponding insert pins.

In the first embodiment and the second embodiment of the ring disposing step, protrusions are provided on one side of the mold and the insert pins, and insert portions into which the protrusions are inserted are formed in the other side.

The first embodiment of the ring disposing step 110 has the structure such that the spacing protrusion 12 can only slightly move. Therefore, in the first embodiment of the ring disposing step 110, the spacing protrusions 12 can be easily coupled to the corresponding pin mounting holes 4*c* of the mold 4, so that the operation can be facilitated, the defective proportion in the ring disposing operation can be reduced, and the productivity can be improved.

In the second embodiment of the ring disposing step, the positions of the protrusions (not shown) of the mold must be precisely consistent with those of the insert portions (not shown) of the insert pins.

Therefore, when manufacturing the retainer ring, the defective proportion of the ring disposing step of the first embodiment is lower than that of the second embodiment, and the operation of disposing the ring in the mold in the first embodiment is easier than that of the second embodiment Hereinafter, the first embodiment of the ring disposing step 110 will be described in more detail with reference to FIG. 7.

The mold 4 includes a stationary mold part 4*a* and a movable mold part 4*b* which is separably coupled to the stationary mold part 4*a*.

The stationary mold part 4*a* has a plurality of pin mounting holes 4*c* therein. The spacing protrusions 12 of the insert pins 10 are inserted into the corresponding pin mounting holes 4*c*.

The ring disposing step 110 includes a mold opening operation, a ring disposing operation and a mold closing operation. In the mold opening operation, the movable mold part 4*b* is removed from the stationary mold part 4*a* to open the space in the mold 4.

In the ring disposing operation, the spacing protrusions 12 protruding from the surface of the insert ring member 2 are inserted into the corresponding pin mounting holes 4*c* so that the insert ring member 2 is disposed in the mold 4 such that it is spaced apart from the inner surface of the stationary mold part 4*a* by a predetermined distance.

In the mold closing operation, the movable mold part 4*b* is coupled to the stationary mold part 4*a* to seal the space in the mold 4 after the ring disposing operation has been completed.

In the ring disposing step 110, the insert ring member 2 is disposed in the mold 4 such that space is defined around the insert ring member 2 in the mold 4.

The ring disposing operation can be conducted in various manners depending on the direction in which the movable mold part 4*b* moves when it is removed from or coupled to the stationary mold part 4*a*.

For example, the movable mold part 4*b* may move in the horizontal direction to open or close the mold 4. In this case, the insert ring member 2 is coupled to the stationary mold part 4*a* while it stands.

Alternatively, the movable mold part 4*b* may move in the vertical direction to open or close the mold 4. In this case, the insert ring member 2 is coupled to the stationary mold part 4*a* while it is laid.

Furthermore, the ring disposing operation can be conducted in a variety of different manners depending on the structure for opening or closing the mold 4.

Figure 2:
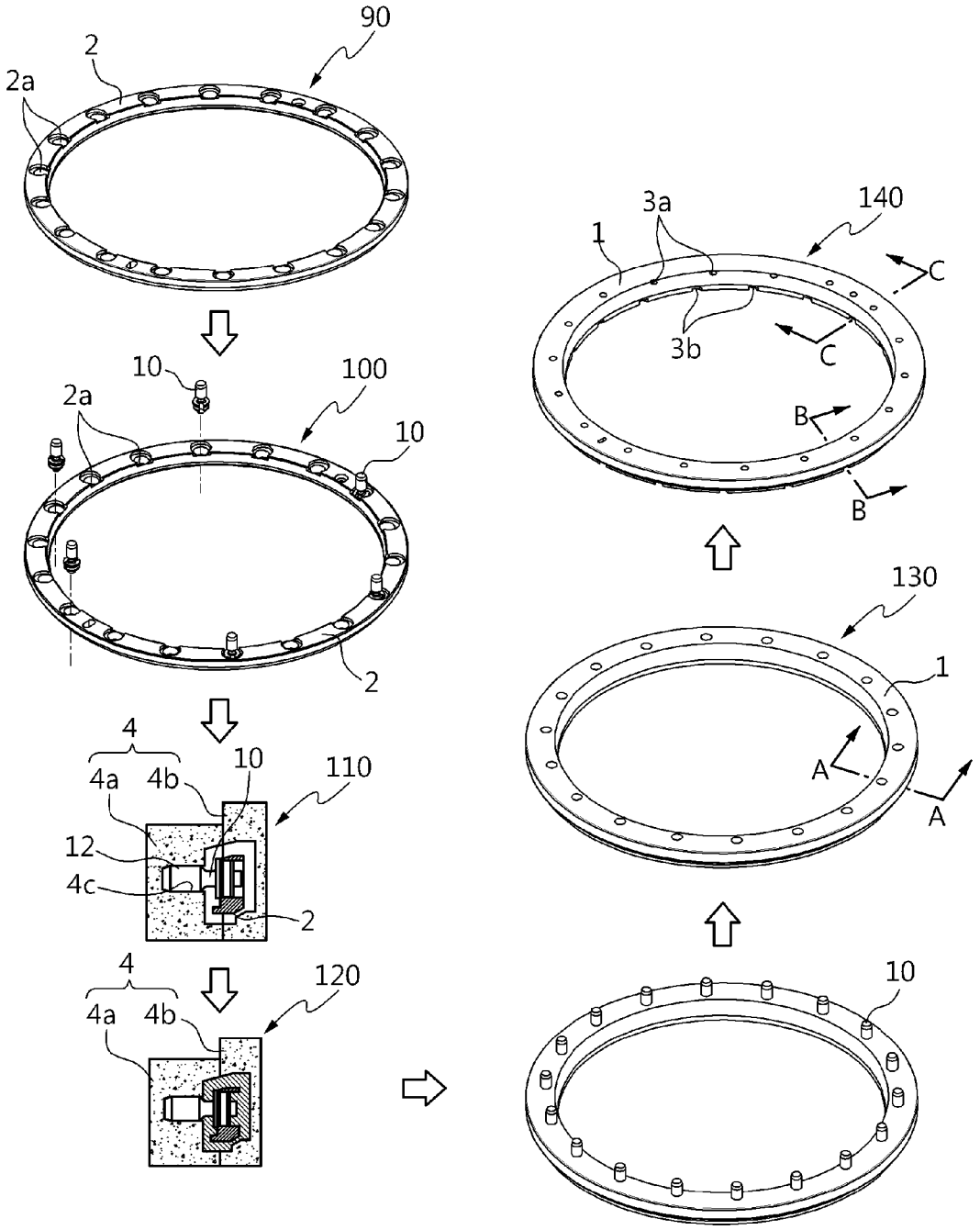
FIG. 2 is of views successively showing a method of manufacturing a retainer ring for chemical mechanical polishing device, according to the present invention.

Referring to FIG. 2, after the ring disposing step 110 has been completed, the molding step 120 of injecting molten material for forming the shell member (hereinafter, referred to as shell material) into the space in the mold 4 is conducted.

In the molding step 120, shell material is charged into the space which is defined around the insert ring member 2 in the mold 4.

When the shell material has completely dried, it forms the shell member 3 covering the insert ring member 2.

The molding step 120 includes an injection operation of injecting shell material into the space in the mold 4, and a dry operation of hardening the shell material to form the shell member 3 after the injection operation has completed.

Preferably, the shell material comprises polyetheretherketone (PEEK).

Alternatively, an engineering plastic may be used as the shell material.

Representative examples of the engineering plastic include polyphenylene sulfide (PPS), polyamide, polybenzimidazole (PBI), polycarbonate, acetal, polyetherimide (PEI), polybutylene terephthalate (PBT), polyethylene terephthalate (PET), etc.

The shell member 3 is formed by hardening the shell material. The shell member 3 covers the entirety of the periphery of the insert ring member 2 and comes into contact with a polishing pad of the chemical mechanical polishing device.

Referring to FIG. 3, each insert pin 10 for manufacturing the retainer ring has a pin fastening hole 11*a* which is longitudinally formed through the fitting part 11.

More preferably, the pin fastening hole 11*a* is open through the circumferential outer surface of the fitting part 11.

Thus, at the molding step 120, the shell material can be smoothly charged into the pin fastening hole 11*a*.

Figure 4:
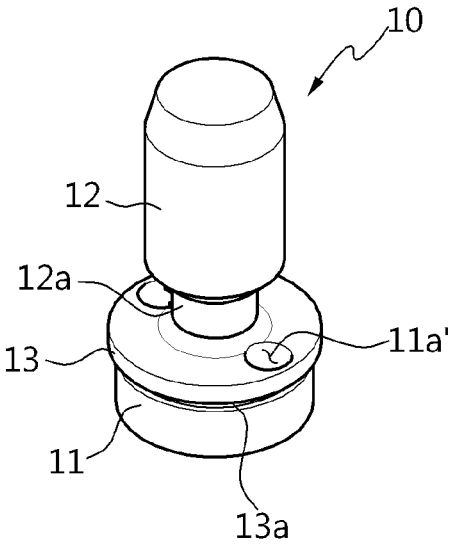
FIG. 4 is a perspective view showing another embodiment of the insert pin used for manufacturing the retainer ring for chemical mechanical polishing device according to the present invention.

Referring to FIG. 4 showing a comparative example of the insert pin 10, a pin fastening hole 11*a*' may be formed such that it is not open through the circumferential outer surface of the fitting part 11. In this case, in the molding step 120, the shell material may not be smoothly charged into the pin fastening hole 11*a*'.

The molding step 120 includes filling the pin fastening hole 11*a* with the shell material. The shell material charged into the pin fastening hole 11*a* functions to connect the upper and lower portions of the shell member 3 to each other.

Therefore, the coupling force between the shell member 3 and the insert ring member 2 can be enhanced. The coupling force between the insert pins 10 and the shell member 3 can also be increased.

The insert pins 10 are firmly integrated with the shell member 3 by the shell material hardening in the pin fastening holes 11*a*.

In the insert pin 10 of FIG. 3, the seating guide groove 13*a* communicates with the pin fastening hole 11*a*. In the molding step 120, shell material is supplied and charged into the seating guide groove 13*a* through the pin fastening hole 11*a*.

In the molding step 120, the seating guide groove 13*a* is filled with the shell material.

The insert pin 10 for manufacturing the retainer ring is more firmly integrated with the shell member 3 by the hardening of the shell material charged into the seating guide groove 13*a*.

Furthermore, a pin fastening protrusion 14 protrudes from a lower end of the fitting part 11 of each insert pin 10.

At the molding step 120, the shell material is charged into the pin coupling holes 2*a* and covers the pin fastening protrusions 14 of the insert pins 10.

The pin fastening protrusion 14 increases a contact area between the insert pin 10 and the shell member 3.

Therefore, the insert pin 10 can be more firmly integrated with the shell member 3.

Preferably, the insert pin 10 is made of the same material as the shell material which is injected into the mold 4 at the molding step 120.

Thus, the insert pin 10 can be homogeneously integrated with the shell member 3 covering the insert ring member 2.

Retelling to FIG. 2, the present invention further includes the pin cutting step 130 at which portions protruding from the retainer ring 1 that is taken out of the mold 4 after the molding step 120 has been completed are removed from the retainer ring 1.

At the pin cutting step 130, portions of the spacing protrusions 12 of the insert pins 10 which protrude out of the shell member 3 are cut off.

Figure 8:
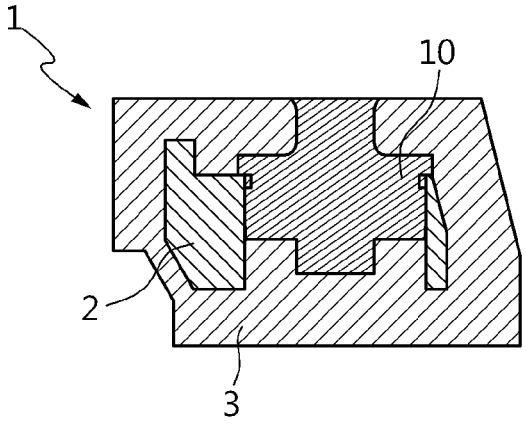
FIG. 8 is a sectional view taken along line A-A' of FIG. 2.

Retelling to FIGS. 3, 5 and 8, a cutting guide depression 12*a* is formed around a circumferential outer surface of a lower end of the spacing protrusion 12. The height of the cutting guide depression 12*a* corresponds to the thickness of the shell member 3.

In the pin cutting step 130, the protruding portion of each spacing protrusion 12 is cut off at a boundary line between the cutting guide depression 12*a* and the spacing protrusion 12.

The cutting guide depression 12*a* indicates the boundary line at which the protruding portion of the spacing protrusion 12 is cut off in the pin cutting step 130, and minimizes the diameter of a portion of the spacing protrusion 12 that is cut.

Therefore, the spacing protrusions 12 can be easily cut in the pin cutting step 130.

Retelling to FIG. 8, in the retainer ring 1 manufactured by the method of the present invention, the insert ring member 2, the insert pins 10 coupled to the respective pin coupling holes 2*a* of the insert ring member 2, and the shell member 3 covering the insert ring member 2 are integrated together.

Referring to FIG. 2, the post-processing step 140 of forming ring mounting holes 3*a* in the retainer ring 1 is conducted after the pin cutting step 130 has been finished. In the post-processing step 140, the ring mounting holes 3*a* are formed in portions of the retainer ring 1 in which the insert pins 10 are inserted.

Figure 9:
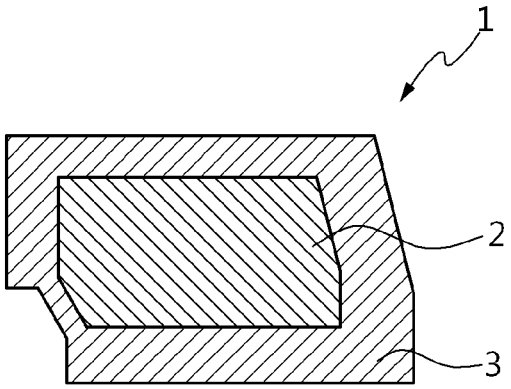
FIG. 9 is a sectional view taken along line C-C' of FIG. 2.

In other words, referring to FIG. 9, the ring mounting holes 3*a* are formed at positions corresponding to the respective pin coupling hole 2*a* of the insert ring member 2 by drilling the insert pins 10.

Hence, when the drilling is conducted at the post-processing step 140, the insert ring member 2 is not processed.

An internal thread is formed on a circumferential inner surface of each ring mounting hole 3*a* so that a bolt is threaded into the ring mounting hole 3*a*.

The retainer ring 1 is mounted to the polishing head of the chemical mechanical polishing device by the coupling using the bolt.

Meanwhile, polishing agent supply groove 3*b* are formed in a lower surface of the shell member 3 at positions spaced apart from each other. The polishing agent supply groove 3*b* may be formed by the mold 4 at the molding step 120 or, alternatively, they may be formed by machining in the post-processing step 140.

Figure 10:
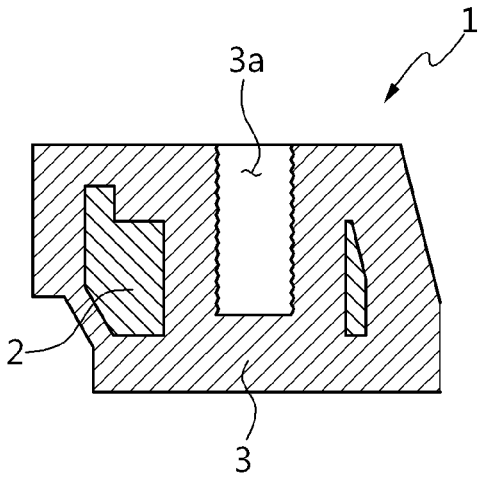
FIG. 10 is a sectional view taken along line B-B' of FIG. 2.

As shown in FIG. 10, the retainer ring 1 for chemical mechanical polishing device which is manufactured by the method according to the present invention is configured such that the periphery of the insert ring member 2 is covered by the shell member 3. Therefore, in the retainer ring 1, the insert ring member 2 made of metal is prevented from being exposed to the outside.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a retainer ring of a chemical mechanical polishing device, comprising:

coupling insert pins into respective pin coupling holes formed in an insert ring member, wherein the pin coupling holes are spaced apart from each other;

disposing the insert ring member in a mold by coupling the insert pins to an interior of the mold such that a space is defined around the insert ring member in the mold; and molding a shell member covering the insert ring member by injecting molten shell material into the mold in which the insert ring member is disposed, wherein each of the insert pins comprises a spacing protrusion protruding above one surface of the insert ring member, and the disposing comprises disposing the insert ring member in the mold by inserting the spacing protrusions of the insert pins into corresponding mounting holes formed in the mold so that the space is defined around the insert ring member.

2. A method for manufacturing a retainer ring of a chemical mechanical polishing device, comprising:

coupling insert pins into respective pin coupling holes formed in an insert ring member, wherein the pin coupling holes are spaced apart from each other;

disposing the insert ring member in a mold by coupling the insert pins to an interior of the mold such that a space is defined around the insert ring member in the mold;

molding a shell member covering the insert ring member by injecting molten shell material into the mold in which the insert ring member is disposed; and manufacturing the insert ring member in which the pin coupling holes are formed at positions spaced apart from each other, before the coupling of the insert pins, wherein the manufacturing the insert ring member comprises reusing synthetic resin obtained from a scrapped retainer ring of chemical mechanical polishing device.

3. A method for manufacturing a retainer ring of a chemical mechanical polishing device, comprising:

coupling insert pins into respective pin coupling holes formed in an insert ring member , wherein the pin coupling holes are spaced apart from each other;

disposing the insert ring member in a mold by coupling the insert pins to an interior of the mold such that a space is defined around the insert ring member in the mold; and molding a shell member covering the insert ring member by injecting molten shell material into the mold in which the insert ring member is disposed, wherein each of the insert pins comprises:

a fitting part tightly fitted into the corresponding pin coupling hole of the insert ring member; and a spacing protrusion protruding from the fitting part upwards so that when the fitting part is tightly fitted into the pin coupling hole, the spacing protrusion protrudes from a surface of the insert ring member, and the coupling comprises tightly fitting the fitting parts of the insert pins into the respective pin coupling holes of the insert ring member, wherein a seating flange protrudes outwards from a circumferential outer surface of the fitting part, the seating flange being seated onto an upper surface of the insert ring member, and the coupling comprises coupling the fitting parts of the insert pins to the respective pin coupling holes such that lower surfaces of the seating flanges of the fitting parts are seated onto the upper surface of the insert ring member, wherein a seating guide groove is formed around a circumferential outer surface of a junction between the lower surface of the seating flange and the fitting part, and the coupling comprises bringing the lower surface of the seating flange into close contact with the upper surface of the insert ring member so that the spacing protrusion is oriented in a vertical direction.

4. A method for manufacturing a retainer ring of a chemical mechanical polishing device, comprising:

coupling insert pins into respective pin coupling holes formed in an insert ring member , wherein the pin coupling holes are spaced apart from each other;

disposing the insert ring member in a mold by coupling the insert pins to an interior of the mold such that a space is defined around the insert ring member in the mold; and molding a shell member covering the insert ring member by injecting molten shell material into the mold in which the insert ring member is disposed, wherein each of the insert pins comprises:

a fitting part tightly fitted into the corresponding pin coupling hole of the insert ring member; and a spacing protrusion protruding from the fitting part upwards so that when the fitting part is tightly fitted into the pin coupling hole, the spacing protrusion protrudes from a surface of the insert ring member, and the coupling comprises tightly fitting the fitting parts of the insert pins into the respective pin coupling holes of the insert ring member, wherein a pin fastening hole is longitudinally formed through the fitting part, and the molding comprises filling the pin fastening hole with the molten shell material such that upper and lower portions of the shell member covering the insert ring member are connected to each other, wherein the pin fastening hole is open through a circumferential outer surface of the fitting part.

5. The method of claim 4, wherein a seating flange protrudes outwards from the circumferential outer surface of the fitting part, the seating flange being seated onto an upper surface of the insert ring member, and a seating guide groove is formed around a circumferential outer surface of a junction between a lower surface of the seating flange and the fitting part, the seating guide groove communicating with the pin fastening hole, and the molding comprises filling the pin fastening hole and the seating guide groove with the molten shell material.

6. The method of claim 3, wherein a pin fastening protrusion protrudes from a lower end of the fitting part, and the molding comprises filling the pin coupling holes with the molten shell material so that the pin fastening protrusions of the insert pins are covered with the molten shell material in lower portions of the pin coupling holes.

7. The method of claim 1, further comprising:

cutting portions of the insert pins that protrude from the shell member of the retainer ring taken out of the mold after the molding has been finished.

8. The method of claim 7, wherein a cutting guide depression is formed around a circumferential outer surface of a lower end of the spacing protrusion, a height of the cutting guide depression corresponding to a thickness of the shell member, and the cutting comprises cutting each of the spacing protrusions at a boundary line between the cutting guide depression and the spacing protrusion.

9. The method of claim 7, further comprising:

forming ring mounting holes by processing the insert pins after the cutting has been finished.

* * * * *